US008407898B2

(12) United States Patent
Marshall

(10) Patent No.: US 8,407,898 B2
(45) Date of Patent: Apr. 2, 2013

(54) SYSTEM AND METHOD FOR FORMING A MOVABLE SLAB FOUNDATION

(75) Inventor: Frederick S. Marshall, Arlington, TX (US)

(73) Assignee: Frederick S. Marshall, inventor, Arlington, TX (US)

( * ) Notice: Subject to any disclaimer, the term of this patent is extended or adjusted under 35 U.S.C. 154(b) by 403 days.

(21) Appl. No.: 12/834,585

(22) Filed: Jul. 12, 2010

(65) Prior Publication Data

US 2011/0005078 A1 Jan. 13, 2011

Related U.S. Application Data

(60) Provisional application No. 61/224,785, filed on Jul. 10, 2009.

(51) Int. Cl.
*B21D 47/01* (2006.01)

(52) U.S. Cl. ... 29/897.33; 29/897; 29/897.3; 29/897.31; 29/897.312; 52/122.1; 52/123.1; 52/125.1; 52/576

(58) Field of Classification Search ..... 29/897, 29/897.34, 897.31, 897.312, 897.33, 700, 29/711; 52/122.1, 123.1, 125.1, 576
See application file for complete search history.

(56) References Cited

U.S. PATENT DOCUMENTS

| | | | | |
|---|---|---|---|---|
| 3,385,015 | A * | 5/1968 | Hadley | 52/223.8 |
| 3,705,469 | A * | 12/1972 | Eriksson | 52/125.4 |
| 3,882,585 | A * | 5/1975 | Costes et al. | 29/897 |
| 4,997,314 | A | 3/1991 | Hartman | |
| 5,131,790 | A | 7/1992 | Simpson | |
| 5,228,807 | A | 7/1993 | Willcox, Jr. | |
| 5,259,702 | A | 11/1993 | Simpson | |
| 5,713,701 | A | 2/1998 | Marshall | |
| 6,390,734 | B1 * | 5/2002 | Marshall | 405/230 |
| 6,539,685 | B2 * | 4/2003 | Bell et al. | 52/741.15 |
| 6,634,830 | B1 | 10/2003 | Marshall | |
| 6,923,599 | B2 * | 8/2005 | Kelso | 405/230 |
| 8,171,678 | B2 * | 5/2012 | Stanford et al. | 52/125.5 |
| 2007/0028557 | A1 | 2/2007 | Kelly et al. | |
| 2009/0211178 | A1 * | 8/2009 | Marshall et al. | 52/126.6 |
| 2011/0056150 | A1 * | 3/2011 | Marshall | 52/125.1 |

* cited by examiner

*Primary Examiner* — Richard Chang
(74) *Attorney, Agent, or Firm* — Bracewell & Giuliani LLP

(57) ABSTRACT

An embodiment of the system for forming a movable slab foundation as comprised by the present invention has a slab foundation, at least one substantially vertical support member, at least one support surface, and at least one support sleeve. The at least one supports sleeve surrounds the at least one support member and is encased within the slab foundation and is capable of movement axially along the length of the at least one support member. The at least one vertical support member is capable of rotation relative to the at least one support sleeve to restrict the movement of the at least one support sleeve downward relative to the at least one vertical support member, thereby maintaining the height of the at least one support sleeve and the slab foundation relative to the at least one support surface.

14 Claims, 4 Drawing Sheets

SYSTEM AND METHOD FOR FORMING A MOVABLE SLAB FOUNDATION

CROSS REFERENCE TO RELATED APPLICATIONS

This application claims the benefit of and priority to U.S. Provisional Patent Application No. 61/224,785, filed on Jul. 10, 2009, and herein incorporated by reference in its entirety

FIELD OF THE INVENTION

This invention relates in general to forming an adjustable foundation, and in particular to a concrete slab foundation capable of being raised above the ground.

BACKGROUND OF THE INVENTION

Many structures have been built on foundations or slabs made of concrete poured on top of soil. Constant changes in the weather and moisture levels in the soil frequently cause damage to such a foundation. In many instances, the foundation may buckle or even crack. This phenomenon occurs for a variety of reasons, including uneven changes in the water content of supporting soils, uneven compacting of soils, and uneven loads being placed on soils. Over time, uneven movement in the soils under a foundation can cause a foundation to bend or crack.

Therefore, it would be desirable to provide a method and apparatus that would allow a foundation to be poured on top of soil and subsequently raised to a desired height to eliminate potential problems caused by soil movement and/or problematic soils.

SUMMARY OF THE INVENTION

An embodiment of the system for forming a movable slab foundation as comprised by the present invention has a slab foundation. At least one substantially vertical support member has a hollow body with first and second ends. The first end of the substantially vertical support member is in abutting contact with at least one support surface. At least one support sleeve surrounds the at least one support member. The at least one support sleeve is encased within the slab foundation and is capable of movement axially along the length of the at least one support member. The at least one vertical support member is capable of rotation relative to the at least one support sleeve to restrict the movement of the at least one support sleeve downward relative to the at least one vertical support member, thereby maintaining the height of the at least one support sleeve and the slab foundation relative to the at least one support surface.

An embodiment of the system for forming a movable slab foundation as comprised by the present invention has a slab foundation. At least one substantially vertical support member has a substantially cylindrical hollow body with first and second ends. The first end of the at least one support member is in abutting contacting with at least one support surface. A support plate is connected to the second end of the at least one substantially vertical support member. The support plate has an aperture located in and extending therethrough and a plurality of tabs extending radially outward from the outer peripheries of the support plate at select intervals. At least one support sleeve has a hollow body with inner and outer surfaces. The at least one support sleeve surrounds the at least one support member. The inner surface of the at least one support sleeve has a plurality of tabs extending along and radially inward from the inner surface at select intervals. The inner surface of the at least one support sleeve also has a plurality of apertures located in and extending therethrough. The outer surface of the at least one support sleeve has at least one reinforcing bar connected to and extending outwardly therefrom. The plurality of tabs of the at least one support sleeve are initially offset from the plurality of tabs of the support plate. The outer surface of the sleeve body and the at least one reinforcing bar are encased within the slab foundation. The at least one support sleeve and the slab foundation are capable of movement axially along the length of the at least one support member. The at least one support member and the support plate are capable of rotation relative to the at least one support sleeve to align the plurality of tabs of the support plate with the plurality of tabs of the at least one support sleeve to thereby restrict the movement of the at least one support sleeve downward relative to the at least one support member. At least one lifting member extends through the aperture in the support plate and is surrounded by the at least one support member. The at least one lifting member has a body with first and second ends, the first end being in abutting contact with the at least one support surface.

An embodiment of the present invention is directed to a method for forming a movable slab foundation. The method comprises placing a plurality of support surfaces below an intended slab foundation area. A plurality of support sleeves are placed in abutting contact with the plurality of support surfaces. A plurality of support members are placed within the plurality of support sleeves. The plurality of support members are slid down within the plurality of support sleeves and into abutting contact with the plurality of support surfaces. A slab foundation is formed such that it encases the plurality of support sleeves. The plurality of support sleeves are simultaneously lifted to move the slab foundation along the length of the plurality of support members to a desired height. The plurality of support members are rotated relative to the plurality of support sleeves, thereby restricting the movement of the plurality of support sleeves downward relative to the plurality of support members and maintaining the desired height of the slab foundation.

BRIEF DESCRIPTION OF THE DRAWINGS

So that the manner in which the features and benefits of the invention, as well as others which will become apparent, may be understood in more detail, a more particular description of the invention briefly summarized above may be had by reference to the embodiments thereof which are illustrated in the appended drawings, which form a part of this specification. It is also to be noted, however, that the drawings illustrate only various embodiments of the invention and are therefore not to be considered limiting of the invention's scope as it may include other effective embodiments as well.

DETAILED DESCRIPTION OF THE INVENTION

The present invention now will be described more fully hereinafter with reference to the accompanying drawings in which a preferred embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numbers refer to like elements throughout.

Figure 1:
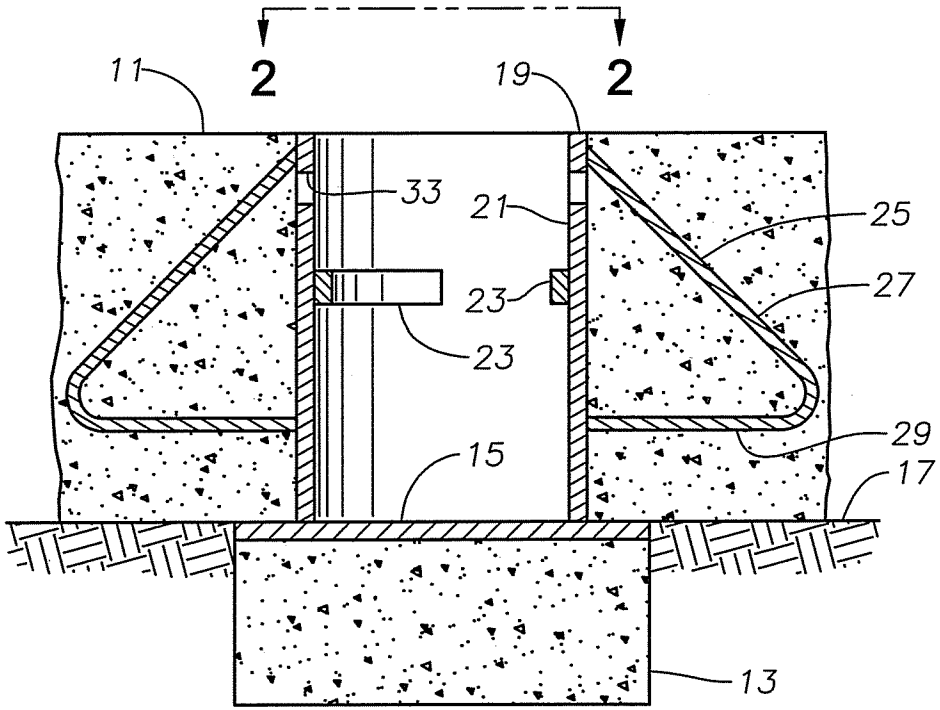
FIG. 1 is a sectional view of a single slab support, illustrating a concrete pier and support sleeve.

Referring to FIG. 1, a foundation slab 11 may be used to support a house or other building or structure. In this embodiment, the slab 11 is of concrete and initially rests on a ground surface 17 and a support surface or pier 13. The foundation or slab 11 is typically supported by a plurality of support surfaces or piers 13, but for simplification purposes, the single pier 13 will be discussed. In this embodiment, the pier 13 is of concrete and has a base plate 15 embedded therein, such that at least the top or upper surface of the base plate 15 is exposed. In this embodiment, the base pate 15 is circular in shape, but in alternate embodiments may comprise different shapes, for example, a rectangle. In an alternate embodiment, the base plate 15 may have anchor bolts or other support members connected to it that extend a selected distance into the pier 13.

In this embodiment, the hole for the pier 13 is dug with a diameter such that the base plate 15 is fully encased within the concrete. Once the hole is dug as desired, the pier 13 is formed by pouring concrete into the hole. The base plate 15 is then embedded in the concrete of the pier 13 such that the top or upper surface of the base plate 15 is substantially parallel with the ground surface 17. As previously discussed, in an alternate embodiment, anchor bolts or other support members may be connected to the base plate 15 and may extend into the concrete of the pier 13 a desired distance below the base plate 15.

Figure 2:
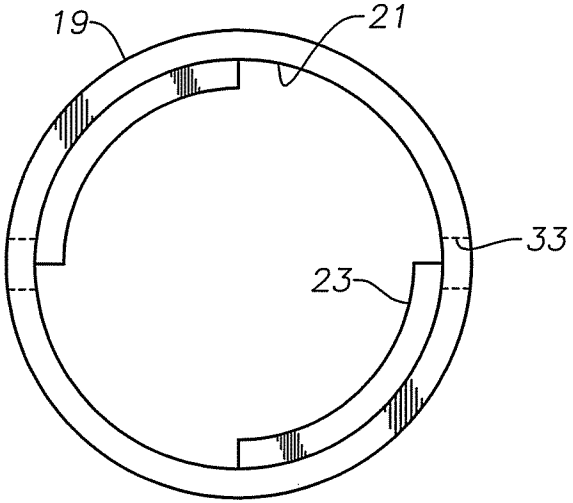
FIG. 2 is a sectional view of the support sleeve taken along the line 2-2 of FIG. 1.

In this embodiment, a cylindrical exterior pipe or support sleeve 19 has an outer diameter that is less than the diameter of the base plate 15. The support sleeve 19 and the base plate 15 are sized such that bottom surface of the support sleeve 19 is in supporting contact with the base plate 15. The length of the support sleeve 19 may be less than or equal to the desired thickness of the concrete slab 11. In this embodiment, the length of the support sleeve 19 is equal to the thickness of the concrete slab 11. An inner surface 21 of the sleeve 19 has a plurality of support tabs 23 connected therein that extend along the inner diameter and radially inward a select distance. The support tab 23 may be connected to the support sleeve 19 through various means, including, but not limited to welding and fasteners. As seen in FIG. 2, in this embodiment, two support tabs 23 are positioned opposite from one another and extend around the inner surface 21 of the support sleeve 19 at ninety degree intervals.

Referring back to FIG. 1, reinforcing bars (rebar) 25 are connected to the outer surface of the sleeve 19. In this embodiment, a first leg 27 of the rebar 25 is connected to and extends outwardly and downwardly at an angle from the sleeve 19. A second leg 29 of the rebar 25 is substantially perpendicular to the support sleeve 19 and extends between the first leg 27 and the sleeve 19. The rebar 25 may be welded around the outer peripheries of the sleeve 19 at desired intervals. In an alternate embodiment, various reinforcing members may be connected to and extend outwardly from the outer peripheries of the sleeve 19 in various shapes and configurations.

A plurality of lift holes or apertures 33 are located in and extend radially outward through the inner surface 21 of the support sleeve 19. In this particular embodiment, two lift holes 33 are positioned opposite from one another and are offset from the support tabs 23. The lift holes 33 are adapted to accept a lifting device or lifting link.

The sleeve assembly 19 is positioned atop the base plate 15. In an alternate embodiment, the lower end of the support sleeve 19 may be lightly tack welded to the base plate 15. The concrete slab 11 is then poured, thereby embedding the rebar 25 and the sleeve 19 within the slab 11. The concrete may be kept from bonding to the concrete pier 13 and the base plate 15 by an optional bond breaker layer (not shown).

Figure 3:
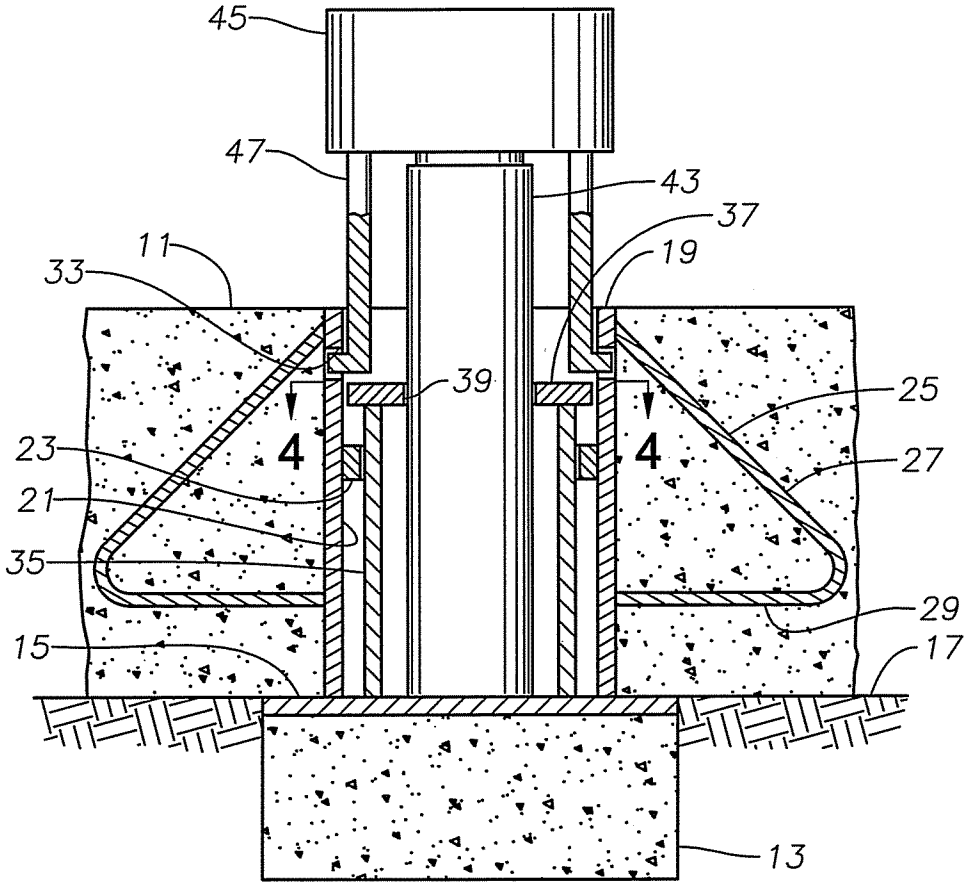
FIG. 3 is a sectional view of the single slab support with a support pipe and lifting rod inserted and a lifting assembly connected.

Referring to FIG. 3, after the slab 11 has hardened, a support member or support pipe 35 with a smaller diameter than the sleeve 19 is inserted into the sleeve 19 and lowered until a lower first end portion makes contact with the base plate 15. The support pipe 35 is positioned such that the first end portion of the support pipe 35 rests on the base plate 15. A support flange or support plate 37 is connected to an upper second end portion of the support pipe 35. The support pipe 35 extends upwardly a select distance from the base plate 15. The length of the supporting pipe 35, and subsequently, the height of the support plate 37 can be varied to accommodate various desired slab 11 heights.

Figure 4:
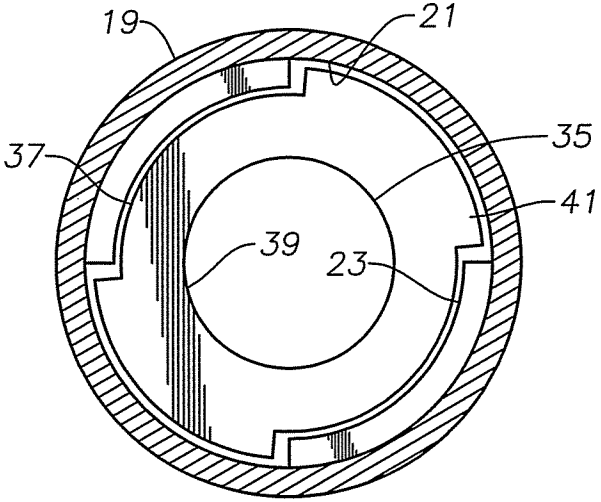
FIG. 4 is a sectional view of the support sleeve, support pipe, and support plate taken along the line 4-4 of FIG. 3.

As illustrated in FIG. 4, the support plate 37 has a hole or aperture 39 located in and extending axially therethrough that is adapted to receive a lifting member. The outer peripheries of the support plate 37 are designed with a plurality of tabs 41 that have a greater diameter than the rest of plate 37. In this embodiment, the tabs 41 are positioned opposite one another and extend around the plate 37 at intervals of less than ninety degrees. The desired final height of the slab 11 is determined by the height of the plate 37 and the plate tabs 41 relative to the base plate 15. In an alternate embodiment, the plate 37 may be threaded to the second end of the support pipe 35, thereby allowing the vertical position and height of the plate 37, the tabs 41, and the corresponding final height of the slab 11 to be adjusted.

Referring back to FIG. 3, a lifting member or solid lifting rod 43 with a smaller diameter than the aperture 39 in the support plate 37 is inserted into the aperture 39 and the support pipe 35 and lowered until it makes contact with the base plate 15. The length of the lifting rod 43 can be calculated such that it may remain within the support pipe 35 once the slab 11 has reached its final desired height. Alternatively, the lifting rod 43 may be removed from the support pipe 35 once the slab 11 has reached its desired height. After the lifting rod 43 is in place, a lifting device 45 is mounted on the top of the support rod 43. In this embodiment, the lifting device 45 is a hydraulic jack mounted on the top of the support rod 43. Attachment members or attachment rods 47 are connected to the lift holes 33 in the sleeve 19, in order to lift the slab 11 to its desired height. The hydraulic jack 45 is connected to the attachment rods 47. In order to lift the sleeve 19 and the slab foundation 11, the support pipe 35 is rotated such that tabs 41 on the support plate 37 and the support tabs 23 on the inner surface 21 of the support sleeve 19 are offset from one another, thereby allowing the sleeve 19 and the tabs 23 to pass by the plate 37 and the tabs 41 without interference (FIG. 4).

Figure 6:
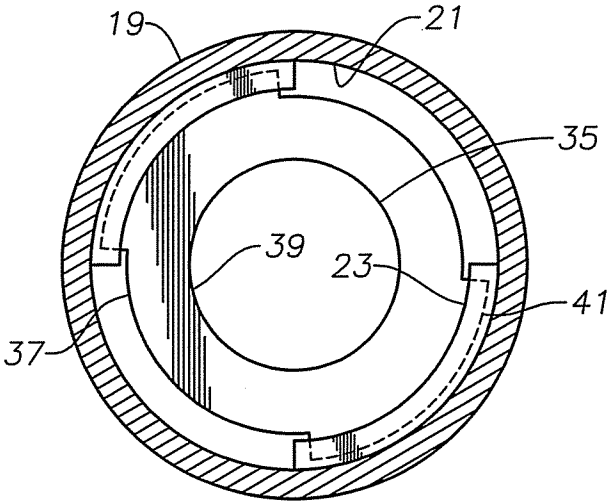
FIG. 6 is a sectional view of the support sleeve, support pipe, and support plate taken along the line 6-6 of FIG. 5.
Figure 5:
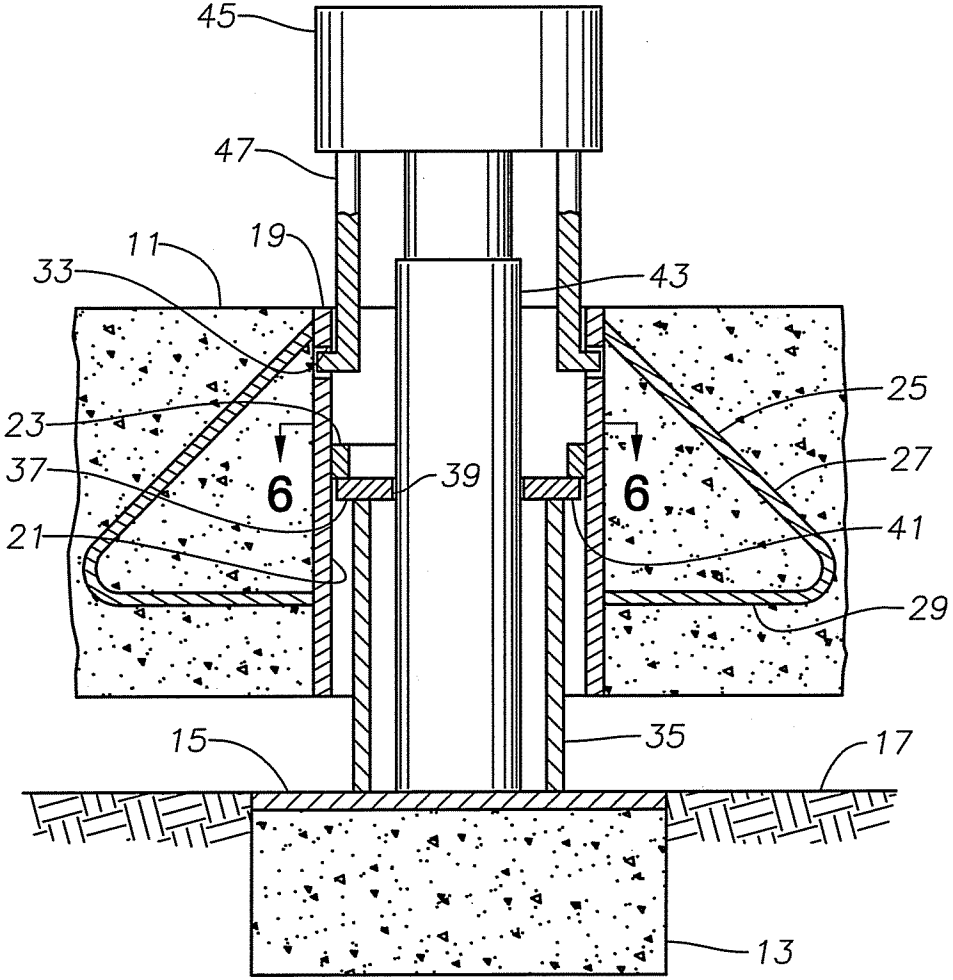
FIG. 5 is a sectional view of the single slab support with the slab raised.

Referring to FIG. 5, hydraulic fluid pressure is applied to the jack 45, causing the foundation slab 11 to be lifted above the ground to the desired height. Once the slab 11 has reached its desired height, the tabs 23 on the inner surface 21 of the sleeve 19 will be positioned above the plate 37 and the tabs 41. In order to secure the slab 11 at the desired height, the support pipe 35 and the plate 37 are rotated such that plate tabs 41 and the support tabs 23 are aligned with one another (FIG. 6). Once the support tabs 23 are positioned above the plate tabs 41, the sleeve 19 and the slab foundation 11 are lowered such that tabs 23 of the sleeve 19 rest upon the tabs 41 on the plate 37. Once the tabs 23 of the support sleeve 19 are securely resting upon the tabs 41 of the plate 37, the attachment rods 47, the hydraulic jack 45, and the lifting rod 43 are removed.

Figure 7:
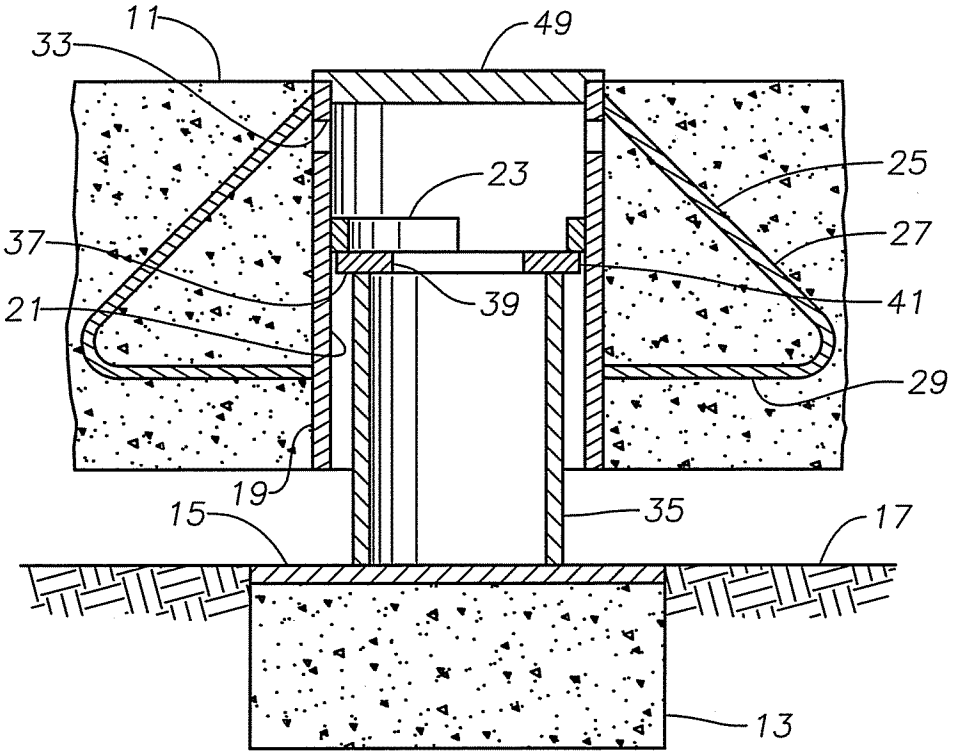
FIG. 7 is a sectional view of a single slab support with the slab raised to a final height.

Referring to FIG. 7, the lifting rod 43 (FIG. 5) may be removed if its length is greater than the final height of the slab 11. Whether the lifting rod 43 is removed or remains within the support pipe 35, once the slab 11 has reach its desire height, a cap 49 can be inserted into the sleeve 19. In the event that the height of the slab 11 needs to be adjusted, the cap 49 may be removed, the lifting rod 43 reinserted if not already in place, and the hydraulic jack 45 and the attachment rods 47 reconnected. Once the weight of the slab 11 is lifted from the support pipe 19, if the plate 37 is threaded to the support pipe 35, the height could be adjusted by rotating the plate 37 to a desired height. If the plate 37 is not threaded to the support pipe 35, the slab 11 is lowered to its original position, and the support pipe 35 and the plate 37 may be replaced with a supporting pipe and a plate with a length to accommodate the new desired height. Once the desired height is reached, as previously illustrated, the slab 11 may be secured in place by rotating the new support pipe and plate and lowering the weight of the slab 11 and the sleeve 19 onto the new support pipe and plate. As previously discussed, the hydraulic jack 45, the attachment rods 47, and the lifting rod 43 may be removed and the cap 49 reinstalled in the sleeve 19.

The invention has significant advantages. The invention provides a method and apparatus that allows a foundation to be poured on top of soil and subsequently raised to a desired height to eliminate potential problems caused by soil movement and/or problematic soils.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as set forth in the following claims.

The invention claimed is:

1. A system for forming a movable slab foundation, the system comprising:

a slab foundation;

at least one support surface;

at least one substantially vertical support member having a hollow body with first and second ends, the first end abuttingly contacting the at least one support surface, at least one support sleeve surrounding the at least one support member, the at least one support sleeve being encased within the slab foundation and being capable of moving axially along the length of the at least one support member; and the at least one vertical support member being capable of rotation relative to the at least one support sleeve to thereby restrict movement of the at least one support sleeve downward relative to the at least one vertical support member.

2. The system of claim 1, further comprising:

at least one lifting member surrounded by the at least one support member, the at least one lifting member having a body with first and second ends, the first end abuttingly contacting the at least one support surface, the second end adapted to be coupled to a lifting device to move the at least one support sleeve and the slab foundation axially along the length of the at least one support member.

3. The system of claim 2, wherein the at least one support sleeve further comprises:

a hollow body with inner and outer surfaces, the inner surface having a plurality of tabs extending around the inner surface at select intervals and radially inward a select distance, and the outer surface having at least one reinforcing bar connected to and extending outwardly therefrom, the inner surface having a plurality of apertures located in and extending therethrough and adapted to accept a connecting member; and wherein the at least one vertical support member further comprises:

a hollow body with inner and outer surfaces, a support plate connected to the second end of the at least one vertical support member, the support plate having a plurality of tabs extending radially outward from the outer peripheries of the support plate a select distance, the plurality of tabs of the support plate being initially offset from the plurality of tabs of the at least one support sleeve, the vertical support member being capable of rotation relative to the at least one support sleeve to thereby secure the axial position of the at least one support sleeve and the slab foundation along the length of the at least one support member.

4. The system of claim 3, wherein the at least one reinforcing bar further comprises:

a first leg connected to and extending outwardly and downwardly at an angle from the at least one support sleeve; and a second leg substantially perpendicular to the at least one support sleeve, connected to and extending between the first leg and the at least one support sleeve.

5. A system for forming a movable slab foundation, the system comprising:

a slab foundation;

at least one support surface;

at least one substantially vertical support member having a substantially cylindrical hollow body with first and second ends, the first end abuttingly contacting the at least one support surface;

a support plate connected to the second end of the at least one substantially vertical support member, the support plate having an aperture located in and extending therethrough, the support plate having a plurality of tabs extending radially outward from the outer peripheries of the support plate at select intervals;

at least one support sleeve surrounding the at least one support member, the at least one support sleeve having a hollow body with inner and outer surfaces, the inner surface having a plurality of tabs extending along and radially inward from the inner surface at select intervals, the inner surface having a plurality of apertures located in and extending therethrough, the outer surface having at least one reinforcing bar connected to and extending outwardly therefrom, the plurality of tabs of the at least one support sleeve being initially offset from the plurality of tabs of the support plate, the outer surface of the body and the at least one reinforcing bar being encased within the slab foundation and the at least one support sleeve and the slab foundation being capable of moving axially along the length of the at least one support member;

the at least one support member and the support plate being capable of rotation relative to the at least one support sleeve to align the plurality of tabs of the support plate with the plurality of tabs of the at least one support sleeve to thereby restrict the movement of the at least one support sleeve downward relative to the at least one support member; and at least one lifting member extending through the aperture in the support plate and surrounded by the at least one support member, the at least one lifting member having a body with first and second ends, the first end abuttingly contacting the at least one support surface.

6. The system of claim 5, wherein the system further comprises:

a lifting device coupled to the second end of the body of the at least one lifting member to move the at least one support sleeve and the slab foundation axially along the length of the at least one support member; and a plurality of attachment members connected to and extending between the plurality of apertures in the support sleeve and the lifting device.

7. The system of claim 5, wherein the at least one support surface further comprises:

a concrete pier; and a base plate encased within the concrete pier.

8. The system of claim 7, wherein the at least one reinforcing bar further comprises:

a first leg connected to and extending outwardly and downwardly at an angle from the at least one support sleeve; and a second leg substantially perpendicular to the at least one support sleeve, connected to and extending between the first leg and the at least one support sleeve.

9. A method for forming a movable slab foundation, the method comprising:

placing a plurality of support surfaces below an intended slab foundation area;

placing a plurality of support sleeves in abutting contact with the plurality of support surfaces;

placing a plurality of support members within the plurality of support sleeves and sliding them down within the plurality of support sleeves and into abutting contact with the plurality of support surfaces;

forming a slab foundation such that it encases the plurality of support sleeves;

simultaneously lifting the plurality of support sleeves to move the slab foundation along the length of the plurality of support members to a desired height; and rotating the plurality of support members relative to the plurality of support sleeves, thereby restricting the movement of the plurality of support sleeves downward relative to the plurality of support members and maintaining the desired height of the slab foundation.

10. The method of claim 9, further comprising:

placing a plurality of lifting members within the support members such that first ends of the plurality of lifting members are in abutting contact with the plurality of support surfaces;

connecting a plurality of lifting devices to the second ends of the plurality of lifting members;

connecting the plurality of lifting devices to the plurality of support sleeves; and simultaneously actuating the plurality of lifting devices.

11. The method of claim 10, wherein actuating the plurality of lifting devices is performed by an automatic lifting system connected to control actuation of the lifting assemblies simultaneously.

12. The method of claim 10, wherein simultaneously lifting the plurality of support sleeves to move the slab foundation along the length of the plurality of support members to a desired height further comprises offsetting a plurality of tabs on the plurality of support members with a plurality of tabs on the plurality of support sleeves.

13. The method of claim 10, wherein rotating the plurality of support members relative to the plurality of support sleeves comprises aligning a plurality of tabs on the plurality of support members with a plurality of tabs on the plurality of support sleeves.

14. The method of claim 9, wherein the plurality of support surfaces comprise a base plate encased within a concrete pier.

* * * * *